US006764797B2

(12) United States Patent
Sano et al.

(10) Patent No.: US 6,764,797 B2
(45) Date of Patent: Jul. 20, 2004

(54) TONER FOR MICR

(75) Inventors: Takayuki Sano, Shizuoka (JP); Tatsuru Matsumoto, Shizuoka (JP)

(73) Assignee: Tomoegawa Paper Co., Ltd., Tokyo (JP)

( * ) Notice: Subject to any disclaimer, the term of this patent is extended or adjusted under 35 U.S.C. 154(b) by 0 days.

(21) Appl. No.: 10/092,922

(22) Filed: Mar. 8, 2002

(65) Prior Publication Data

US 2003/0044705 A1 Mar. 6, 2003

(30) Foreign Application Priority Data

Mar. 12, 2001 (JP) ..... 2001-068883
Mar. 21, 2001 (JP) ..... 2001-079680

(51) Int. Cl.[7] ..... G03G 9/083

(52) U.S. Cl. ..... 430/106.2; 430/108.23; 430/108.8; 430/108.7

(58) Field of Search ..... 430/106.1, 106.2, 430/106.3, 108.7, 108.8, 108.23

(56) References Cited

U.S. PATENT DOCUMENTS 5,439,772 A * 8/1995 Takagi et al. ..... 430/106.1
5,780,197 A * 7/1998 Kubota ..... 430/137.17
5,914,209 A * 6/1999 Grushkin ..... 430/106.2
6,268,099 B1 * 7/2001 Eguchi et al. ..... 430/108.8
6,465,144 B1 * 10/2002 Hashimoto et al. ..... 430/106.1
2001/0053491 A1 * 12/2001 Arai ..... 430/108.6

FOREIGN PATENT DOCUMENTS

JP 03125157 A * 5/1991 ..... G03G/09/08
JP 6043689 2/1994
JP 6282100 10/1994
JP 7271085 10/1995
JP 11327204 11/1999
JP 11327205 11/1999

* cited by examiner

*Primary Examiner*—Christopher Rodee
(74) *Attorney, Agent, or Firm*—McDermott Will & Emery LLP

(57) ABSTRACT

A toner for MICR comprises at least a binder resin, magnetite particles comprising a mixture of granular magnetite and acicular magnetite, and a wax, wherein a ratio by weight of said acicular magnetite in said magnetite particles is 0.1–0.5 to the granular magnetite of 1.0, said magnetite particles are contained in an amount of 15–50% by weight in the toner, said granular magnetite has residual magnetization of 5–15 emu/g and saturation magnetization of 70–95 emu/g, and said acicular magnetite has residual magnetization of 20–50 emu/g and saturation magnetization of 70–95 emu/g.

7 Claims, No Drawings

TONER FOR MICR

BACKGROUND OF THE INVENTION

1) Field of the Invention

The present invention relates to a toner for MICR (magnetic ink character recognition) capable of printing magnetic images by a printer of one-component magnetic developing system.

2) Description of the Related Art

In recent years, documents capable of magnetic ink character recognition (MICR) and particularly checks or bills have been easily prepared by one-component magnetic developing system with a magnetic toner. The MICR that is a system of reading magnetized images by a magnetic head is not conveniently used because images are obtained by offset printing with magnetic ink. A process of printing with a two-component developer which has been put to practical use is not also conveniently used, because the process requires a large-sized machine as compared with that for the one-component developer. As small-sized printers, there are those for heat-sensitive transfer processes. However, almost all of them are single-purpose machines for printing only MICR characters. It is accordingly desired to develop a small-sized printer capable of printing characters or symbols together with the MICR characters. Regarding the use for MICR, the one-component developing process has been developed hitherto because of using a compact machine, keeping easy maintenance and being capable of printing images other than MICR characters.

In the prior art, magnetic materials having large magnetization were attempted to use for the toner for MICR. Japanese Laid-open Patent Publication Nos. Hei 6-282100 and Hei 7-271085 discloses the use of acicular magnetite. The acicular magnetite has, however, problems that it is easily exposed on the surface of toner particles and is easily released from the toner particles by sliding friction with a magnetic head. Although appropriate saturation magnetization is necessary for development by the one-component magnetic developing process, signal strength becomes too high when the acicular magnetite is added in an amount necessary to development. The amount of the acicular magnetite is restricted because of its inferior dispersing ability. It is therefore difficult to satisfy both of the saturation magnetization required for development and the residual magnetization required for signal strength. It is furthermore impossible to satisfy every requirement even if it is used together with magnetite of other type. Moreover, the toner containing magnetite generates lacking or omission of characters in magnetic image formed by the development and, consequently, troubles are often caused upon magnetic reading.

The signal strength is influenced by a deposition amount of the toner, and the deposition amount of the toner is influenced by charging property of the toner. It is therefore very important for the toner for MICR to maintain the stabilized charging property. In order to control the charging property, charge controlling agents are generally used. Selection of the charge controlling agent, however, is not easy to carry out, because the charging property is also influenced by the magnetic material.

The Japanese Laid-open Patent Publication Nos. Hei 6-282100, 6-43689 and 7-271085 discloses addition of various kinds of waxes to a toner for MICR in order to improve resistance against sliding friction. The resultant toner however often causes problems in magnetic reading even if the image formed has no problem in reading by eyes.

In the prior arts, as above-mentioned, there is no MICR toner which satisfies excellent resistance against sliding friction with the magnetic head and appropriate signal strength and forms magnetic images having stabilized image density and good image quality upon copying a number of sheets, without hurting image density and image quality such as, fog, lacking or omission of characters, fine line reproducibility, etc.

SUMMARY OF THE INVENTION

An object of the present invention is accordingly to provide a toner for MICR having sufficient resistance against sliding friction with the magnetic head, having appropriate signal strength by which reading errors are not caused, and having no trouble in image qualities such as image density, fog, etc.

Another object of the present invention is to provide a toner for MICR having stabilized charging property, which keeps appropriate toner images capable of reading by the magnetic head.

A further object of the present invention is to provide a MICR toner for MICR capable of forming magnetic images having stabilized image quality upon copying a large number of sheets. A furthermore object of the present invention is to provide a toner having good transferability and excellent fine line reproducibility and forming images without causing lacking or omission of characters.

A toner for MICR of the present invention comprises a binder resin, magnetite particles comprising a mixture of granular magnetite and acicular magnetite, and a wax, wherein a ratio by weight of said acicular magnetite in said magnetite particles is 0.1–0.5 to the granular magnetite of 1.0, and said magnetite particles are included in an amount of 15–50% by weight in the toner.

In the MICR toner according to the present invention, said granular magnetite is preferred to have residual magnetization of 5–15 emu/g and saturation magnetization of 70–95 emu/g, and said acicular magnetite is preferred to have residual magnetization of 20–50 emu/g and saturation magnetization of 70–95 emu/g.

In the present invention, the above-mentioned wax is preferred to have a melting point measured by DSC (referred as to "DSC melting point" hereinafter) of 60–100° C., and a preferable wax is natural gas-type Fischer-Tropsch wax. It is also preferred that the toner contains a charge controlling argent which preferably consists of at least two charge controlling materials, at least one of which is a chrome azo dye.

The MICR toner according to the present invention may contain a silicone oil and an inorganic fine powder on the surface of the toner particles. In such a case, it is preferred that the silicone oil has the viscosity of 10–1000 centistokes at 25° C. and contains the volatile ingredients of 1.5% by weight or less and that the amount of the silicone oil is in a range of 0.01–0.5% by weight.

DETAILED DESCRIPTION OF PREFERRED EMBODIMENTS

The toner for MICR according to the present invention comprises at least a binder resin, a magnetic material and a wax, as main components, and contains, if necessary, a coloring agent, a releasing agent other than the wax, a charge controlling agent and other additives. A fluidizing agent may also be allowed to attach to the surface of toner particles.

Specific examples of the binder resin of the toner according to the present invention include homopolymers and copolymers of styrene and substituted styrene such as polystyrene, poly-p-chlorostyrene, polyvinyltoluene, styrene-p-chlorostyrene copolymer, styrene-vinyltoluene copolymer, etc.; copolymers of styrene and acrylic acid ester such as styrene-methyl acrylate copolymer, styrene-ethyl acrylate copolymer, styrene-n-butyl acrylate copolymer, etc.; copolymers of styrene and methacrylic acid ester such as styrene-methyl methacrylate copolymer, styrene-ethyl methacrylate copolymer, styrene-n-butyl methacrylate copolymer, etc.; styrene-acrylic acid ester-methacrylic acid ester terpolymer; styrene copolymers composed of styrene and other vinyl monomers such as styrene-acrylonitrile copolymer, styrene-vinyl methyl ether copolymer, styrene-butadiene copolymer, styrene-vinyl methyl ketone copolymer, styrene-acrylonitrile-indene copolymer, styrene-maleic acid ester copolymer, etc.; polymethyl methacrylate, polybutyl methacrylate, polyacrylic acid ester resin, polyester resin, polyvinyl acetate, polyamide resin, epoxy resin, polyvinyl butyral resin, polyacrylic acid-phenol resin, phenol resin, aliphatic or alicyclic hydrocarbon resin, petroleum resin, chlorinated paraffin, polyvinyl chloride, polyvinylidene chloride, etc., which can be used alone or as a mixture of two or more of them.

Of these resins, styrene-acrylic acid ester copolymer resin and polyester resin are preferably used in the present invention.

The magnetite particles incorporated in the toner for MICR of the present invention are composed at least of granular magnetite and acicular magnetite. The content of the magnetite particles in the toner should be in a range of 15–50% by weight and preferably 20–45% by weight. When the amount of the magnetite particles is lower than 15% weight, saturation magnetization necessary for the development and residual magnetization necessary for the development cannot be obtained. When the amount of it is in excess of 50% by weight, there are problems that fixing strength reduces to cause deterioration of the resistance against sliding friction, that the saturation magnetization is in excess of the value required for the development, and that the signal strength exceeds the appropriate level.

The magnetite particles are composed at least of granular magnetite and acicular magnetite. The ratio by weight of said acicular magnetite in said magnetite particles should be in a range of 0.1–0.5, and preferably 0.20–0.45, to 1.0 of the granular magnetite. When the ratio by weight of the acicular magnetite to the granular magnetite is in excess of 0.5, the signal strength exceeds an appropriate range. On the other, when it is lower than 0.1, the signal strength is lower than the appropriate range due to the lack of desired residual magnetization. As a result, a reader sorter of the MICR reading machine causes reading errors.

The granular magnetite used in the present invention is preferred to have the residual magnetization in a range of 5–15 emu/g, and particularly 7–13 emu/g. The saturation magnetization of it is preferred to be in a range of 70–95 emu/g, and particularly 80–90 emu/g. The residual magnetization of higher than 15 emu/g brings about excess magnetization and excess signal strength, while the residual magnetization of lower than 5 emu/g causes lack of the signal strength to result in reading errors. When the saturation magnetization is lower than 70 emu/g, such saturation magnetization is insufficient for the development. On the other hand, when it exceeds 95 emu/g, it shows a tendency to exceeding the saturation magnetization necessary for the development.

Specific examples of the granular magnetite in the present invention include those having irregular, spherical, hexahedral and octahedral shapes. Conventional granular magnetite having a particle size of 0.2–0.3 micrometers and an aspect ratio of less than 2.0 can be used in the present invention.

The acicular magnetite used in the present invention is preferred to have the residual magnetization in a range of 20–50 emu/g, and particularly 25–40 emu/g. The saturation magnetization of it is preferred to be in a range of 70–95 emu/g, and particularly 75–85 emu/g. The residual magnetization of lower than 20 emu/g causes the lack of signal strength and that of higher than 50 emu/g brings about excess signal strength. The saturation magnetization of lower than 70 emu/g does not bring the saturation magnetization necessary for the development and that of higher than 95 emu/g shows a tendency to exceeding the saturation magnetization necessary for the development. Conventional acicular magnetite having a particle size of approximately 0.6 micrometers and an aspect ratio of 2.0 or more can be used in the present invention.

Other magnetic materials can be used, if necessary, together with the granular magnetite and the acicular magnetite.

To the toner for MICR according to the present invention, the wax is added in order to ensure excellent releasing property between a heating roll for fixation and the toner or to ensure the excellent resistance against sliding friction with the magnetic head. In such a case, it is preferred to add the wax having a DSC melting point in a range of 60–110° C. and particularly 85–100° C. The wax having the DSC melting point of lower than 60° C. easily causes problems in preservation stability of the toner and also becomes to have poor fluidity. When the DSC melting point of it is higher than 110° C., the wax has inferior low temperature fixability because of a poor effect for reducing of melt viscosity of the toner, and consequently the toner images are easily peeled off by sliding friction with the magnetic head because of having reduced fixing strength. Furthermore, the toner images are easily stripped off when they are brought in contact with other articles or when a tape is allowed to adhesion thereto.

The term "DSC melting point" used in this specification means an endothermic peak temperature measured by differential scanning calorimetry, which can be measured by means of a measuring device: SSC-5200 made by Seiko Instruments Inc. by a method which comprises increasing the temperature from 20° C. to 150° C. at a rate of 10° C./minute and then cooling rapidly from 150° C. to 20° C., repeating this step twice and measuring the endothermic peak temperature of the second step.

As the wax, hydrocarbon wax is suitable to use. Specific examples of the wax used for the toner for MICR according to the present invention include polyolefin wax such as polyethylene and polypropylene having a low molecular weight, paraffin wax, Fischer-Tropsch wax, carnauba wax, candelilla wax, rice wax, etc. These waxes can be used alone or as a mixture of them. Of these waxes, Fischer-Tropsch wax and particularly of natural gas type or coal type are preferred to use. The Fischer-Tropsch wax has excellent low temperature fixability as compared with olefin wax, because of having a lower melting point than the olefin wax. It also has excellent preservation stability as compared with conventional petroleum or coal type paraffin wax, because of having a very small amount of low melting point component.

The Fischer-Tropsch wax formed from natural gas is particularly preferred to use. It is because the Fischer-Tropsch wax formed from natural gas gives excellent anti-offsetting property against a thermal fixing roll and excellent preservation stability to the toner. Further, it can be produced in low cost, because the production is free from a step of taking a blue water gas in the case of coal type.

The wax is preferred to have a penetration number of 2 or less at 25° C. measured by JIS K-2235. If it is larger than 2, the toner has poor fluidity and easily causes trouble in preservation stability and triboelectric charging property.

The content of the wax in the toner is preferred in a range of 2.0–15% by weight, and preferably 4.0–10% by weight. When the content of wax is lower than 2.0% by weight, it exhibits an inferior effect as the releasing agent and causes problem in anti-offsetting property and resistance against sliding friction. The content of more than 15% by weight causes trouble in preservation stability.

The toner for MICR according to the present invention is preferred to contain a charge controlling agent. In such a case, it is particularly suitable to incorporate at least 2 kinds of charge controlling materials, at least one of which is a chrome azo dye.

The charge controlling agent is classified into a charge controlling material which affords positive charge to the toner and a charge controlling material which affords negative charge to the toner. Specific examples of the positive charge controlling material include nigrosine and modified material thereof with metal salt of fatty acid, quaternary ammonium salts such as tributylbenzylammonium-1-hydroxy-4-naphthosulfonate, tetrabutylammonium tetrafluoroborate, etc., di-organo-tin oxides such as dibutyltin oxide, dioctyltin oxide, dicyclohexyltin oxide, etc., di-organo-tin borates such as dibutyltin borate, dioctyltin borate, dicyclohexyltin borate, etc., which can be used alone or as a combination of two or more thereof.

Of these, nigrosine compounds and quaternary ammonium salts are particularly preferred to use. A preferable amount to be added of them is in a range of 0.1–5% by weight.

Specific examples of the negative charge controlling material include organometallic compounds and chelate compounds such as acetylacetone metal chelate, monoazo metallic chelate, metallic chelate or salt of naphthoic acid or salicylic acid, which can be used alone or as a combination of two or more thereof. Of these, salicylic acid type metal chelate and monoazo metal chelate are particularly preferred to use. A preferable amount to be added of them is in a range of 0.1–5% by weight. In the toner for MICR of the present invention, though the negative charge controlling material is preferred to use, the charging property can be controlled by using suitably the above mentioned both charge controlling materials.

Since the toner for MICR of the present invention contains black magnetite particles, no coloring agent may be used commonly. However, the coloring agent can be used, if necessary. Specific examples of the coloring agent include carbon black, aniline blue, charcoil blue, chrome yellow, ultramarine blue, quinoline yellow, methylene blue chloride, phthalocyanine blue, Malachite Green oxalate, lamp black, rose bengale, rhodamine dyes, anthraquinone dyes, monoazo and disazo pigments, mixtures of them, etc. The coloring agent should be incorporated in such an amount that toner images having sufficient image density are formed, and it is generally preferred to be added in an amount of 20 parts by weight based on 100 parts by weight of the binder resin.

Further, higher fatty acid, olefin-maleic acid anhydride copolymer, etc. may be suitably added to the toner of the present invention in order to protect the photosensitive member and to obtain toner images having high quality without deterioration of developing property.

Moreover, in the toner of the present invention, it is preferred to attach a fluidizing agent to the surface of toner particles. Typical examples of the fluidizing agent include silica and titanium dioxide, and hydrophobic silica is preferred.

The toner for MICR according to the present invention can be produced by the known method comprising blending the above mentioned components, melting with kneading the mixture and pulverizing the resultant mass. Moreover, it may be produced by a polymerization method which comprises blending monomers for the binder with other ingredients and polymerizing the mixture.

In the present invention, the toner according to the present invention is preferred to have the residual magnetization in a range of 4–12 emu/g, and more preferably 5–8 emu/g. The saturation magnetization of it is preferred to be in a range of 15–40 emu/g, and more preferably 25–35 emu/g. The residual magnetization of higher than 12 emu/g brings about excess magnetization and excess signal strength, while the residual magnetization of lower than 4 emu/g causes lack of the signal strength to result in the reading error. When the saturation magnetization is lower than 15 emu/g, such saturation magnetization is insufficient for the development. When it exceeds 40 emu/g, it shows a tendency to exceeding the saturation magnetization necessary for the development.

In the toner for MICR according to the present invention, it is preferred that the silicone oil adheres to the surface of the toner particles in order to afford the resistance against sliding friction with the magnetic head and to obtain sufficient image density and fine line reproducibility. Silicone oil having the viscosity at 25° C. of 10–1,000 centistokes is preferably used in the present invention because it uniformly adheres to the surface of the toner particles. Silicone oil having the viscosity at 25° C. of 20–300 centistokes and, particularly, 50–200 centistokes can more preferably used in the present invention. Specific examples of the silicone oil include dimethyl polysiloxane, phenyl group containing polysiloxane, etc. Modified silicone oils such as methylstyrene modified silicone oil, olefin modified silicone oil, polyether modified silicone oil, alcohol modified silicone oil, fluorine modified silicone oil, amino modified silicone oil, mercapto modified silicone oil, epoxy modified silicone oil, carboxyl modified silicone oil, higher fatty acid modified silicone oil, amide modified silicone oil, etc. may be used depending on the charging property thereof.

The amount of the silicone oil adhering to the surface of toner particles depends upon the average particle size of the toner particles. For example, in the case of toner particles having a volume average particle size of 7–12 micrometers in the present invention, the amount of the silicone oil is in a range of 0.01–0.5 parts by weight, preferably 0.02–0.2 parts by weight and more preferably 0.02–0.1 parts by weight based on 100 parts by weight of the toner particles. The amount of the silicone oil being less than 0.01 parts by weight based of 100 parts by weight of the toner particles easily cause inferior transfer efficiency of the toner image, while the amount of larger than 0.5 parts by weight tends to cause reduction of the image density or generation of black solid memory in the case of copying a large number of sheets.

The toner of the present invention containing the above mentioned amount of the silicone oil has excellent fluidity, solid uniformity and transfer efficiency, and the toner lump is not produced. Accordingly, it become possible to prevent toner carrying failures on the toner holding member in single-component developing system and to completely inhibit generation of the untransfer of characters when the toner image is transferred to thick transfer materials such as paper for checks and bills, etc.

In the toner according to the present invention, it is also preferred to add an inorganic fine powder as an external additive to the toner so as to adhere to the surface of the toner particles. Specific examples of the inorganic fine powder include silica, titanium dioxide, alumina, zinc oxide, etc. Of these, hydrophobic silica is suitable to use. Furthermore, the inorganic fine powder may consist of inorganic fine particles (A) having the reverse polarity to the toner particles and inorganic fine particles (B) having the same polarity as the toner particles. In such a case, hydrophobic silica having BET specific surface area of 100–300 $m^2/g$ is preferable as the inorganic particles (B) having the same polarity to the toner particles. Regarding silica, the silica treated with hexamethyldisilazane or polydimethylsiloxane type coupling agent is used as the negative polarity silica, and the silica treated with aminosilane coupling agent, etc. is used as the positive polarity silica.

Regarding the amount of the inorganic fine powder in the toner, it is preferred that the sum total of the inorganic particles (A) and inorganic particles (B) is in a range of 0.1–0.6 parts by weight based on 100 parts by weight of the toner particles, and that the inorganic fine particles (B) having the same polarity as the toner particles is used in an amount of 0.1–3.0 parts by weight, and the inorganic fine particles (A) having the reverse polarity to the toner particles is used in an amount of 0.05 parts by weight or more but the same as or less than that of the inorganic fine particles (B) having the same polarity as the toner particles.

When the amount of the inorganic powder is less than 0.1 parts by weight, the chargeability of the toner deteriorates and thus stabilized excellent image quality can not be obtained because of too low flow ability of the toner. Furthermore, the burden depends on drive systems such as the printer, thereby causing mechanical failure such as gear creaks, etc. When the amount is in excess of 6.0 parts by weight, inorganic fine particles release from the toner particles and, consequently, the printer is fouled and image defects such as white spots, etc. appear because of development by only the released fine particles. When the amount of the inorganic fine particles (A) is in excess of the amount of the inorganic fine particles (B), the charge quantity of the toner reduces and the reverse polarity toner is easily formed to result in fogging or scattering of the toner.

In the toner for MICR according to the present invention, it is preferred that the residual magnetization of it is in a range of 4–12 emu/g and preferably 5–8 emu/g. If the residual magnetization of the toner is in excess of 12 emu/g, the magnetization and the signal strength become too excess. On the other hand, if it is less than 4 emu/g, the signal strength is lacking to cause reading errors.

The toner for MICR according to the present invention can be produced by the conventional method which comprises melting with heat, kneading and pulverizing. Starting materials necessary for producing the toner, such as binder resin, magnetite, etc. are blended by means of a mixer such as super mixer. They were then kneaded with heat by means of a twin-screw kneading extruder, followed by pulverizing by means of a mill such as jet-mill and classifying by a classifier such as air stream classifier to produce the toner particles. The toner particles can also be produced by the method which comprises blending monomers for the binder resin with other ingredients and polymerizing the monomers. To the resultant toner particles, the above mentioned silicone oil and inorganic fine powder are then added so that they adhere to the surface of the toner particles. The addition of them can be carried out by the conventional method. For example, they can be adhered to the surface of the toner particles by a mechanical process using the conventional agitator such as turbine type agitator, Henschel mixer, super mixer, etc.

Furthermore, the toner of the present invention can be used not only for the MICR printers but also for common printers. According to the present invention, the toner for MICR is excellent in transferability and fine line reproducibility and can form toner images which do not produce problem in image quality such as image density, fog, lacking or omission of characters, etc. without causing reading errors, because they have the excellent resistance against sliding friction with the magnetic head and hold appropriate signal strength. Further, the present invention can provide the toner for MICR of which the dispersion of the signal strength between manufacturing lots is small.

EXAMPLES

The present invention will be illustrated in the following with reference to examples and comparative examples. The present invention however is not restricted to these examples. All parts used hereinbelow are based on weight.

Example 1

| | |
|---|---|
| Styrene-acrylic acid ester copolymer resin (Trade name: CPR-100, manufactured by Mitsui Chemicals, Inc.) | 54.0 parts |
| Negative charge controlling material (Trade name: TRH, manufactured by Hodogaya Chemical Co., Ltd.) | 1.5 parts |
| Granular magnetite (Trade name: BL-100, manufactured by Titan Kogyo K.K., residual magnetization: 8.5 emu/g, saturation magnetization: 85 emu/g) | 30.0 parts |
| Acicular magnetite (Trade name: MAT-230, manufactured by Toda Kogyo Corp.; residual magnetization: 30 emu/g, saturation magnetization: 81.8 emu/g) | 12.0 parts |
| Fischer-Tropsch wax formed from natural gas (Trade name: FT-100, manufactured by Nippon Seirou Co., Ltd., melting point: 91° C.) | 2.5 parts |

The above-mentioned starting materials were dry-blended by a super mixer and kneaded in a melted state with heat by a twin-screw kneading extruder. The resultant kneaded mixture was then pulverized by a jet mill and classified by an air stream classifier to obtain a negatively charging toner having a volume average particle diameter of 8 micrometers.

To 100 parts of the above-mentioned toner, 1.5 parts of hydrophobic silica (trade name: R972, manufactured by Nippon Aerosil Co., Ltd.) were added, followed by stirring by a Henschel mixer for 5 minutes so as to adhere to the surface of the toner particles, thereby a toner for MICR of the present invention being obtained.

Example 2

| | |
|---|---|
| Polyester resin (Trade name: FC-1198, produced by Mitsubishi Rayon Co., Ltd.) | 54.0 parts |
| Negative charge controlling material (Trade name: Bontron S-44, manufactured by Orient Chemical Industries, Ltd.) | 1.5 parts |
| Granular magnetite (Trade name: BL-200, manufactured by Titan Kogyo K.K.; residual magnetization: 8.5 emu/g, saturation magnetization: 85 emu/g) | 30.0 parts |
| Acicular magnetite (Trade name: CJ-3000B, manufactured by Kanto Denka Kogyo Co., Ltd.; residual magnetization: 34.3 emu/g, saturation magnetization: 83.2 emu/g) | 12.0 parts |
| Fischer-Tropsch wax formed from natural gas (Trade name: FT-100, manufactured by Nippon Seiro Co., Ltd.; melting point: 91° C.) | 2.5 parts |

The above-mentioned starting materials were dry-blended by a super mixer and kneaded in a melted state with heat by a twin-screw kneading extruder. The resultant kneaded mixture was then pulverized by a jet mill and classified by an air stream classifier to obtain a negatively charging toner having a volume average particle diameter of 8 micrometers.

To 100 parts of the above-mentioned toner, 2.5 parts of hydrophobic silica (trade name: R972, manufactured by Nippon Aerosil Co., Ltd.) were added, followed by stirring by a Henschel mixer for 5 minutes so as to adhere to the surface of the toner particles, thereby a toner for MICR of the present invention being obtained.

Comparative Example 1

A toner for comparison was produced by the same manner as in Example 1 except that 40 parts of granular magnetite: BL-100 and 16 parts of acicular magnetite: MAT-230 were used and the amount of the binder resin was changed to 40 parts.

Comparative Example 2

A toner for comparison was produced by the same manner as in Example 1 except that 7.5 parts of granular magnetite: BL-100 and 3 parts of acicular magnetite: MAT-230 were used and the amount of the binder resin was changed to 85.5 parts.

Comparative Example 3

A toner for comparison was produced by the same manner as in Example 1 except that 27 parts of granular magnetite: BL-100 and 15 parts of acicular magnetite were used.

Comparative Example 4

A toner for comparison was produced by the same manner as in Example 1 except that 42 parts of granular magnetite: BL-100 were used alone instead of the magnetite in Example 1.

Comparative Example 5

A toner for comparison was produced by the same manner as in Example 1 except that 42 parts of acicular magnetite: MAT-100 were used alone instead of the magnetite in Example 1.

<Test for Evaluation>

Image density, fog, rub fixing strength, tape peeling strength and signal strength of toner images which were obtained by printing with toners of Examples 1 and 2 and Comparative Examples 1–5 by means of a magnetic single-component type printer (printing rate of A4: 16 sheets/minute) available in the market were evaluated. Results are shown in Table 1.

Methods of evaluation are as follows.

1) Image Density:

Initial mage density of a solid toner image having a size of 25 mm×25 mm and image density after printing 10,000 sheets were measured by a reflection densitometer (RD914) manufactured by Aretag Mac Beth LLC.

2) Fog:

Whiteness of non-image areas was measured by a color-difference meter: ZE2000 made by Nippon Denshoku Industries Co., Ltd., and the initial fog and the fog after printing 10,000 sheets were evaluated as the values of the formula:

(whiteness prior to printing−whiteness after printing).

3) Rub Fixing Strength (Survival Rate %):

A solid toner image having a size of 25 mm×25 mm was rubbed back and forth 3 times by a sand-containing eraser under pressure at 500 g/cm$^2$. The rub fixing strength was calculated from image density X before rubbing and image density Y after rubbing according to the following formula. The resulted value was used in place of the strength against sliding friction with the magnetic head.

$$\text{Rub fixing strength } (\%) = Y/X \times 100$$

4) Tape Peeling Strength (Survival Rate %):

A cellophane tape was allowed to adhere to a solid toner image having a size of 25 mm×25 mm and then peeled it off. The tape peeling strength was calculated from image density P before peeling and image density Q after peeling according to the following formula. The resulted value was used in place of the fixing strength of the image in case of contacting with other articles or when tapes were adhered.

$$\text{Tape peeling strength}(\%) = Q/P \times 100$$

5) Signal Strength (%):

Signal strength was measured by MINI MICR RS232 manufactured by Magtek Co. as an MICR character reader. When the signal strength is in a range of 70–200%, it is evaluated that no reading error is caused in the reader sorter of the MICR system reader.

5-1) Signal Strength (1):

Initial signal strength and signal strength after reading 10,000 sheets were measured.

5-2) Signal Strength (2):

Signal strength of the toner image on one sheet was measured twenty times repeatedly. The value of the first time and the value of 20th time were recorded as the signal strength.

5-3) Signal Strength (3):

A cellophane tape was allowed to adhere on MICR characters and then peeled off. Signal strength before peeling and signal strength after peeling were then measured.

TABLE 1

| | Image density Initial/ 10,000 sheets | Fog Initial/ 10,000 sheets | Rub fixing strength (survival rate %) | Tape peeling strength (survival rate %) | Signal strength (1) Initial/ 10,000 sheets | Signal strength (2) First time/ 20 times | Signal strength (3) Before peeling/after peeling |
|---|---|---|---|---|---|---|---|
| Ex. 1 | 1.38/1.38 | 0.05/0.12 | 98.1 | 92.2 | 163/167 | 165/162 | 165/162 |
| Ex. 2 | 1.39/1.37 | 0.13/0.21 | 97.8 | 93.8 | 170/166 | 168/166 | 166/166 |
| Com. Ex. 1 | 1.40/1.39 | 0.21/0.16 | 80.3 | 75.0 | 215/201 | 210/161 | 212/153 |
| Com. Ex. 2 | 1.38/1.37 | 0.32/0.22 | 98.8 | 95.1 | 59/62 | 63/61 | 60/59 |
| Com. Ex. 3 | 1.39/1.38 | 0.11/0.18 | 97.6 | 91.9 | 212/188 | 208/175 | 210/175 |
| Com. Ex. 4 | 1.38/1.37 | 0.13/0.16 | 97.9 | 93.5 | 67/56 | 60/55 | 63/58 |
| Com. Ex. 5 | 1.38/1.39 | 0.18/0.22 | 78.9 | 68.9 | 321/333 | 320/200 | 318/220 |

In Examples 1 and 2, there was no problem in all of the image density, fog, rub fixing strength, tape peeling strength and signal strength.

In Comparative Example 1, the rub fixing strength and the tape peeling strength were low values and initial signal strength exceeded the appropriate range, because of a large amount of the magnetite.

In Comparative Example 2, the signal strength was below the appropriate range because of a small amount of the magnetite.

In Comparative Example 3, initial signal strength exceeded the appropriate range because of the ratio of acicular magnetite being high.

In Comparative Example 4, the signal strength is below the appropriate range because of using the granular magnetite alone.

In Comparative Example 5, the rub fixing strength and the tape peeling strength were low values and initial signal strength remarkably exceeded the appropriate range because of using the acicular magnetite alone.

Example 3

| | |
|---|---|
| Styrene-acrylic acid ester copolymer resin (Trade name: CPR-100, manufactured by Mitsui Chemicals, Inc.) | 56.0 parts |
| Negative charge controlling material Calix[n]arene compound (Trade name: E-89, manufactured by Orient Chemical Ind., Ltd.) | 0.5 parts |
| Negative charge controlling material (Chrome azo dye; Trade name: TRH, manufactured by Hodogaya Chemical Co., Ltd.) | 1.0 parts |
| Granular magnetite (Trade name: BL-100, manufactured by Titan Kogyo K.K.; residual magnetization: 8.5 emu/g, saturation magnetization: 85 emu/g) | 28.0 parts |
| Acicular magnetite (Trade name: MAT-230, manufactured by Toda Kogyo Corp.; residual magnetization: 30 emu/g, saturation magnetization: 81.8 emu/g) | 12.0 parts |
| Polypropylene wax (Trade name: Viscol 550P, manufactured by Sanyo Chemical Industries, Ltd.) | 2.5 parts |

The above-mentioned starting materials were dry-blended by a super mixer and kneaded in a melted state with heat by a twin-screw kneading extruder. The resultant kneaded mixture was then pulverized by a jet mill and classified by an air stream classifier to obtain a negatively charging toner having a volume average particle diameter of 8 micrometers.

To 100 parts of the above-mentioned toner, 1.5 parts of hydrophobic silica (trade name: R972, manufactured by Nippon Aerosil Co., Ltd.) were added, followed by stirring by a Henschel mixer for 5 minutes so as to attach to the surface of the toner particles, thereby a toner for MICR of the present invention being obtained.

Example 4

| | |
|---|---|
| Polyester resin (Trade name: FC-1198, manufactured by Mitsubishi Rayon Co., Ltd.) | 55.5 parts |
| Negative charge controlling material (Chrome azo dye; Trade name: TRH, manufactured by Hodogaya Chemical Co., Ltd.) | 1.0 parts |
| Negative charge controlling material (Chrome azo dye; Trade name: Bontron S-34, manufactured by Orient Chemical Ind., Ltd.) | 1.0 parts |
| Granular magnetite (Trade name: EPT-500, manufactured by Titan Kogyo K.K.; residual magnetization: 11.6 emu/g, saturation magnetization: 83.0 emu/g) | 28.0 parts |
| Acicular magnetite (Trade name: CJ-3000B, manufactured by Kanto Denka Kogyo Co., Ltd.; residual magnetization: 34.3 emu/g, saturation magnetization: 83.2 emu/g) | 12.0 parts |
| Polyethylene wax (Trade name: PE-130, available in Clariant (Japan) K.K.) | 2.5 parts |

The above-mentioned starting materials were dry-blended by a super mixer and kneaded in a melted state with heat by a twin-screw kneading extruder. The resultant kneaded mixture was then pulverized by a jet mill and classified by an air stream classifier to obtain a negatively charging toner having a volume average particle diameter of 8 micrometers.

To 100 parts of the above-mentioned toner, 2.5 parts of hydrophobic silica (trade name: R972, manufactured by Nippon Aerosil Co., Ltd.) were added, followed by stirring by a Henschel mixer for 5 minutes so as to attach to the surface of the toner particles, thereby a toner for MICR of the present invention being obtained.

Comparative Example 6

A toner for comparison was produced by the same manner as in Example 3 except that 37 parts of granular magnetite: BL-100 and 15 parts of acicular magnetite: MAT-230 were used and the amount of the binder resin was changed to 44 parts.

Comparative Example 7

A toner for comparison was produced by the same manner as in Example 3 except that 35 parts of granular magnetite: BL-100 and 17 parts of acicular magnetite: MAT-230 were used and the amount of the binder resin was changed to 44 parts.

Comparative Example 8

A toner for comparison was produced by the same manner as in Example 3 except that 7.5 parts of granular magnetite: BL-100 and 3.0 parts of acicular magnetite: MAT-230 were used and the amount of the binder resin was changed to 85.5 parts.

Comparative Example 9

A toner for comparison was produced by the same manner as in Example 3 except that 40 parts of granular magnetite: BL-100 were used alone instead of the magnetite in Example 3.

Comparative Example 10

A toner for comparison was produced by the same manner as in Example 3 except that 40 parts of acicular magnetite: MAT-230 were used alone instead of the magnetite in Example 3.

<Test for Evaluation>

Image density, fog, rub fixing strength, tape peeling strength and signal strength of the toner images which were obtained by printing with toners of Examples 3 and 4 and Comparative Examples 6–10 by means of a magnetic single-component type printer (printing rate of A4: 16 sheets/minute) available in the market were evaluated. Results are shown in Table 2.

Methods of evaluation are as follows.

1) Image Density:

Initial mage density of a solid toner image having a size of 25 mm×25 mm and image density after printing 20,000 sheets were measured by a reflection densitometer (RD914) manufactured by Aretag Mac Beth LLC.

2) Fog:

Whiteness of non-image areas were measured by a color-difference meter: ZE2000 manufactured by Nippon Denshoku Industries, Co., Ltd., and the initial fog and the fog after copying 20,000 sheets were evaluated as the value of the formula:

(whiteness prior to printing−whiteness after printing).

3) Rub Fixing Strength (Survival Rate %):

Measurement was carried out by the same method as described in Example 1.

4) Tape Peeling Strength (Survival Rate %):

Measurement was carried out by the same method as described in Example 1.

5) Signal Strength (%):

Initial signal strength and signal strength after printing 20,000 sheets were measured by MINI MICR RS232 made by Magtek Co. as an MICR character reader. When the signal strength is in a range of 70–200%, it is evaluated that no reading error is caused in the reader sorter of the MICR system reader.

TABLE 2

| | Image density Initial/ 20,000 sheets | Fog Initial/ 20,000 sheets | Rub fixing strength (survival rate %) | Tape peeling strength (survival rate %) | Signal strength (%) Initial/ 20,000 sheets |
|---|---|---|---|---|---|
| Ex. 3 | 1.38/1.39 | 0.27/0.31 | 98.3 | 93.3 | 165/171 |
| Ex. 4 | 1.40/1.39 | 0.26/0.33 | 98.0 | 94.1 | 169/176 |
| Com. Ex. 6 | 1.42/1.45 | 0.62/0.28 | 81.8 | 78.0 | 206/221 |
| Com. Ex. 7 | 1.43/1.44 | 0.39/0.46 | 78.0 | 73.2 | 221/233 |
| Com. Ex. 8 | 1.37/1.37 | 0.44/0.46 | 98.8 | 94.5 | 63/64 |
| Com. Ex. 9 | 1.38/1.40 | 0.45/0.69 | 98.5 | 93.8 | 75/66 |
| Com. Ex. 10 | 1.37/1.38 | 0.22/0.79 | 78.5 | 69.0 | 341/356 |

As be shown in Table 2, the toners for MICR according to Examples 3 and 4 were confirmed to have satisfactory properties for practical MICR in the image density, fog, rub fixing strength, tape peeling strength and signal strength throughout continuous printing of 20,000 sheets.

In Comparative Example 6 and 7, fixing strength is inferior and the signal strength exceeded 200% that was the upper limit of the appropriate range throughout continuous printing of 20,000 sheets, because of a large amount of the magnetite.

In Comparative Example 8, the signal strength was lower than 70% which was the lower limit of the appropriate range throughout continuous printing of 20,000 sheets, because of a small amount of the magnetite.

In Comparative Example 9, the signal strength was lower than 70% that was the lower limit of the appropriate range throughout printing when the printing of 20,000 sheets was carried out continuously, because of using the granular magnetite alone.

In Comparative Example 10, fixing strength is inferior and the signal strength exceeded 200% that was the upper limit of the appropriate range throughout continuous printing of 20,000 sheets, because of using the acicular magnetite alone.

Example 5

| | |
|---|---|
| Styrene-acrylic acid ester copolymer resin (Trade name: CPR-100, manufactured by Mitsui Chemicals, Inc.) | 54.0 parts |
| Negative charge controlling material (Trade name: TRH, manufactured by Hodogaya Chemical Co., Ltd.) | 2.0 parts |
| Granular magnetite (Trade name: BL-100, manufactured by Titan Kogyo K.K., residual magnetization: 8.5 emu/g, saturation magnetization: 85 emu/g) | 30.0 parts |
| Acicular magnetite (Trade name: MAT-230, manufactured by Toda Kogyo Corp.; residual magnetization: 30 emu/g, saturation magnetization: 81.8 emu/g) | 12.0 parts |
| Wax (Trade name: Viscol 330P, manufactured by Sanyo Chemical Industries, Ltd.) | 2.0 parts |

The above-mentioned starting materials were dry-blended by a super mixer and kneaded in a melted state with heat by a twin-screw kneading extruder. The resultant kneaded mixture was then pulverized by a jet mill and classified by an air stream classifier to obtain a negatively charging toner having a volume average particle diameter of 8 micrometers.

To 100 parts of the above-mentioned toner, 0.05 parts of silicone oil (trade name: KF96-50CS, manufactured by Shin-etu Chemical Co., Ltd.; viscosity at 25° C.: 50 centistokes; volatile component: 0.5%) were added and stirred by a Henschel mixer so as to adhere to the surface of toner particles. Next, 1.0 part of negative polarity hydrophobic silica (trade name: R972, manufactured by Nippon Aerosil Co., Ltd.) was added, followed by stirring by a Henschel mixer for 5 minutes so as to adhere to the surface of the toner particles. Then, 0.5 parts of positive polarity hydrophobic silica (trade name: NA50H, manufactured by Nippon Aerosil Co., Ltd.) were added, followed by stirring by a Henschel mixer for 5 minutes so as to adhere to the surface of the toner particles, thereby a toner for MICR of the present invention being obtained.

Example 6

| | |
|---|---|
| Polyester resin<br>(Trade name: FC-1198, produced by Mitsubishi Rayon Co., Ltd.) | 54.0 parts |
| Negative charge controlling material<br>(Trade name: Bontron S-44, manufactured by Orient Chemical Ind. Co., Ltd.) | 2.0 parts |
| Granular magnetite<br>(Trade name: BL-200, manufactured by Titan Kogyo K.K.; residual magnetization: 8.5 emu/g, saturation magnetization: 85 emu/g) | 30.0 parts |
| Acicular magnetite<br>(Trade name: CJ-3000B, manufactured by Kanto Denka Kogyo Co., Ltd.; residual magnetization: 34.3 emu/g, saturation magnetization: 83.2 emu/g) | 12.0 parts |
| Wax<br>(Trade name: Viscol 330P, manufactured by Sanyo Chemical Industries, Ltd.) | 2.0 parts |

The above-mentioned starting materials were dry-blended by a super mixer and kneaded in a melted state with heat by a twin-screw kneading extruder. The resultant kneaded mixture was then pulverized by a jet mill and classified by an air stream classifier to obtain a negatively charging toner having a volume average particle diameter of 8 micrometers.

To 100 parts of the above-mentioned toner, 0.05 parts of silicone oil (trade name: KF96-50CS, manufactured by Shin-etu Chemical Co., Ltd.; viscosity at 25° C.: 50 centistokes; volatile component: 0.5%) were added and stirred by a Henschel mixer so as to adhere to the surface of toner particles. Next, 1.0 part of negative polarity hydrophobic silica (trade name: R972, manufactured by Nippon Aerosil Co., Ltd.) was added, followed by stirring by a Henschel mixer for 5 minutes so as to adhere to the surface of the toner particles. Then, 0.5 parts of positive polarity hydrophobic silica (trade name: NA50H, manufactured by Nippon Aerosil Co., Ltd.) were added, followed by stirring by a Henschel mixer for 5 minutes so as to adhere to the surface of the toner particles, thereby a toner for MICR of the present invention being obtained. The residual magnetization value of the toner was 6.1 emu/g.

Example 7

| | |
|---|---|
| Polyester resin<br>(Trade name: FC-1198, manufactured by Mitsubishi Rayon Co., Ltd.) | 66.0 parts |
| Negative charge controlling material<br>(Trade name: Bontron S-44, manufactured by Orient Chemical Ind., Ltd.) | 2.0 parts |
| Granular magnetite<br>(Trade name: BL-200, manufactured by Titan Kogyo K.K.; residual magnetization: 8.5 emu/g, | 21.0 parts |

-continued

| | |
|---|---|
| saturation magnetization: 85 emu/g) | |
| Acicular magnetite<br>(Trade name: CJ-3000B, manufactured by Kanto Denka Kogyo Co., Ltd.; residual magnetization: 34.3 emu/g, saturation magnetization: 83.2 emu/g) | 9.0 parts |
| Wax<br>(Trade name: Viscol 330P, manufactured by Sanyo Chemical Industries, Ltd.) | 2.0 parts |

The above-mentioned starting materials were dry-blended by a super mixer and kneaded in a melted state with heat by a twin-screw kneading extruder. The resultant kneaded mixture was then pulverized by a jet mill and classified by an air stream classifier to obtain a negatively charging toner having a volume average particle diameter of 8 micrometers.

To 100 parts of the above-mentioned toner, 0.1 parts of silicone oil (trade name: KF96-50CS, manufactured by Shin-etu Chemical Co., Ltd.; viscosity at 25° C.: 50 centistokes; volatile component: 0.5%) were added and stirred by a Henschel mixer so as to adhere to the surface of toner particles. Next, 1.0 part of negative polarity hydrophobic silica (trade name: R972, manufactured by Nippon Aerosil Co., Ltd.; BET specific surface area: 120 $m^2/g$) was added as the inorganic fine particles (B), followed by stirring by a Henschel mixer for 5 minutes so as to adhere to the surface of the toner particles. Then, 0.5 parts of positive polarity hydrophobic silica (trade name: NA50H, manufactured by Nippon Aerosil Co., Ltd.; BET specific surface area: 50 $m^2/g$) were added as the inorganic fine particles (A), followed by stirring by a Henschel mixer for 5 minutes so as to adhere to the surface of the toner particles, thereby a toner for MICR of the present invention being obtained. The residual magnetization value of the resultant toner was 6.4 emu/g.

Comparative Example 11

A toner for comparison was produced by the same manner as in Example 5 except that 42 parts of acicular magnetite: MAT-230 were used alone instead of the magnetite in Example 5.

Comparative Example 12

A toner for comparison was produced by the same manner as in Example 5 except that 42 parts of granular magnetite: BL-100 were used alone instead of the magnetite in Example 5.

Comparative Example 13

A toner for comparison was produced by the same manner as in Example 5 except that 82 parts styrene-acrylic acid ester copolymer resin, 10 parts of granular magnetite: BL-100, and 4 parts of acicular magnetite: MAT-230 were used. The residual magnetization value of the resultant toner was 2.2 emu/g.

Comparative Example 14

A toner for comparison was produced by the same manner as in Example 5 except that 41 parts styrene-acrylic acid ester copolymer resin, 39 parts of granular magnetite: BL-100, and 16 parts of acicular magnetite: MAT-230 were used. The residual magnetization value of the resultant toner was 13.1 emu/g.

Comparative Example 15

A toner for comparison was produced by the same manner as in Example 5 except that 39 parts of granular magnetite:

BL-100, and 3 parts of acicular magnetite: MAT-230 were used. The residual magnetization value of the resultant toner was 3.8 emu/g.

Comparative Example 16

A toner for comparison was produced by the same manner as in Example 5 except that 20 parts of granular magnetite: BL-100, and 22 parts of acicular magnetite: MAT-230 were used. The residual magnetization value of the resultant toner was 15.6 emu/g.

<Test for Evaluation>

Image density, fog, lacking of characters (thin line reproducibility, and signal strength of toner images which were obtained by printing with toners of Examples 5 and 6 and Comparative Examples 11 and 12 by means of a magnetic single-component type printer (printing rate of A4: 16 sheets/minute) available in the market were evaluated. Results are shown in Table 3.

Methods of evaluation are as follows.

1) Image Density:

Initial mage density of a solid toner image having a size of 25 mm×25 mm and image density after printing 5,000 sheets were measured by a reflection densitometer (RD914) manufactured by Aretag Mac Beth LLC.

2) Fog:

Whiteness of non-image areas were measured by a color-difference meter: ZE2000 manufactured by Nippon Denshoku Industries, Co., Ltd., and the initial fog and the fog after copying 5,000 sheets were evaluated as the value of the formula:

(whiteness prior to printing−whiteness after printing).

3) Lacking or Omission of Characters (Thin Line Reproducibility):

A character image having an character rate of 5% was copied and the resultant prints were evaluated by visual observation if the lacking or omission of characters was observed or not.

4) Signal Strength (%):

Initial signal strength and signal strength after printing 5,000 sheets were measured by MINI MICR RS232 made by Magtek Co. as an MICR character reader. When the signal strength is in a range of 70–200%, it is evaluated that no reading error is caused in the reader sorter of the MICR system reader.

TABLE 3

| | Image density Initial/ 5,000 sheets | Fog Initial/ 5,000 sheets | Lacking or omission of characters (thin line reproduci-bility) | Signal strength (%) Initial/ 5,000 sheets |
|---|---|---|---|---|
| Ex. 5 | 1.39/1.37 | 0.3/0.4 | nothing | 147/152 |
| Ex. 6 | 1.38/1.36 | 0.2/0.3 | nothing | 172/161 |
| Ex. 7 | 1.40/1.37 | 0.4/0.3 | nothing | 163/152 |
| Com. Ex. 11 | 1.37/1.36 | 0.2/0.5 | nothing | 231/229 |
| Com. Ex. 12 | 1.38/1.29 | 0.3/0.5 | nothing | 56/48 |
| Com. Ex. 13 | 1.41/1.36 | 0.6/0.8 | nothing | 29/32 |
| Com. Ex. 14 | 1.21/1.18 | 0.4/0.6 | nothing | 132/122 |
| Com. Ex. 15 | 1.37/1.35 | 0.4/0.5 | nothing | 63/49 |
| Com. Ex. 16 | 1.36/1.33 | 0.5/0.6 | nothing | 224/218 |

As be shown in Table 3, the toners for MICR according to Examples 5–7 were confirmed to have satisfactory properties for practical MICR in the image density, fog, lacking of characters, and signal strength throughout continuous printing of 5,000 sheets.

In Comparative Example 11, the signal strength exceeded 200% that was the upper limit of the appropriate range throughout continuous printing of 5,000 sheets, because of using the acicular magnetite alone.

In Comparative Example 12, the signal strength was lower than 70% that was the lower limit of the appropriate range throughout printing when the printing of 5,000 sheets was carried out continuously, because of using the granular magnetite alone.

In Comparative Example 13, the fog was somewhat increased and the signal strength was insufficient and less than the lower limit of the appropriate range, because of using less than 15% by weight of the magnetite particles.

In Comparative Example 14, the chargeability deteriorated to result in reduced image density, and the appropriate development quality could not be obtained, because of using more than 50% by weight of the magnetite particles.

In Comparative Example 15, the signal strength was insufficient and less than the lower limit of the appropriate range, because of the ratio of acicular magnetite being less than 0.1.

In Comparative Example 16, the flow ability deteriorated and the signal strength greatly exceeded the upper limit of the appropriate range, because of the ratio of acicular magnetite being larger than 0.5.

What is claimed is:

1. A toner for MICR comprising at least a binder resin, magnetite particles and a wax, said magnetite particles comprising a mixture of granular magnetite and acicular magnetite, wherein said granular magnetite has residual magnetization of 5–15 emu/g and saturation magnetization of 70–95 emu/g, and said acicular magnetite has residual magnetization of 20–50 emu/g and saturation magnetization of 70–95 emu/g, wherein a ratio by weight of said acicular magnetite to granular magnetite is 0.1–0.5 to 1.0, and wherein said magnetite particles are included in an amount of 15–50% by weight in the toner, and wherein said wax has a melting point measured by DSC of 60–100° C.

2. A toner for MICR according to claim 1, wherein said wax is Fischer-Tropsch wax.

3. A toner for MICR according to claim 2, wherein said Fischer-Tropsch wax is Fischer-Tropsch wax formed from natural gas.

4. A toner for MICR according to claim 1, wherein said toner contains a charge controlling agent.

5. A toner for MICR comprising at least a binder resin, magnetite particles and a wax, said magnetic particles comprising a mixture of granular magnetite and acicular magnetite, wherein said granular magnetite has residual magnetization of 5–15 emu/g and saturation magnetization of 70–95 emu/g, and said acicular magnetite has residual magnetization of 20–50 emu/g and saturation magnetization of 70–95 emu/g, wherein a ratio by weight of said acicular magnetite to granular magnetite is 0.1–0.5 to 1.0, wherein said magnetite particles are included in an amount of 15–50% by weight in the toner, and wherein said toner contains a charge controlling agent consisting of at least two charge controlling materials, at least one of which is a chrome azo dye.

6. A toner for MICR comprising at least a binder resin, magnetite particles and a wax, said magnetic particles comprising a mixture of granular magnetite and acicular magnetite, wherein said granular magnetite has residual magnetization of 5–15 emu/g and saturation magnetization of 70–95 emu/g, and said acicular magnetite has residual magnetization of 20–50 emu/g and saturation magnetization of 70–95 emu/g, wherein a ratio by weight of said acicular magnetite to granular magnetite is 0.1–0.5 to 1.0, wherein said magnetite particles are included in an amount of 15–50% by weight in the toner, and wherein a silicone oil and an inorganic fine powder adhere to the surface of toner particles, and said inorganic fine powder consists of inorganic fine particles (A) having the reverse polarity to the toner particles and inorganic fine particles (B) which is hydrophobic silica having BET specific surface area in a range of 100–300 $m^2/g$ and having the same polarity as the toner.

7. A toner for MICR according to claim 6, wherein the amount of said silicone oil is in a range of 0.01–0.5% by weight.

* * * * *